United States Patent [19]

Schwarz et al.

[11] Patent Number: 5,005,352

[45] **Date of Patent: * Apr. 9, 1991**

[54] CLEARANCE CONTROL METHOD FOR GAS TURBINE ENGINE

[75] Inventors: Fred M. Schwarz; Clifton J. Crawley, Jr., both of Glastonbury; Anthony F. Rausco, Middletown; Ken R. Lagueux, Berlin, all of Conn.

[73] Assignee: United Technologies Corporation, Hartford, Conn.

[ * ] Notice: The portion of the term of this patent subsequent to Apr. 9, 2007 has been disclaimed.

[21] Appl. No.: 372,398

[22] Filed: Jun. 23, 1989

[51] Int. Cl.[5] ..... F02C 7/18

[52] U.S. Cl. ..... 60/39.02; 60/39.75

[58] Field of Search ..... 60/39.02, 39.29, 39.75; 415/116, 117, 178

[56] References Cited

U.S. PATENT DOCUMENTS

| | | | |
|---|---|---|---|
| 4,019,320 | 4/1977 | Redinger, Jr. et al. . | |
| 4,304,093 | 12/1981 | Schulze | 60/39.29 |
| 4,329,114 | 5/1982 | Johnston et al. . | |
| 4,487,016 | 12/1984 | Schwarz et al. . | |
| 4,513,567 | 4/1985 | Deveau et al. | 60/39.02 |
| 4,576,547 | 3/1986 | Weiner et al. | 415/116 |
| 4,815,272 | 3/1989 | Laurello | 60/39.75 |
| 4,849,895 | 7/1989 | Kervistin | 60/39.75 |

*Primary Examiner*—Louis J. Casaregola

*Attorney, Agent, or Firm*—Troxell K. Snyder

[57] ABSTRACT

A method for scheduling the flow of cooling air to a gas turbine engine achieves a varying clearance between the turbine blade tips and surrounding annular shroud responsive to the current engine power level. Excess clearance is provided during operation at less than maximum normal engine power to accommodate the transient decrease in clearance following a step change in engine power level.

5 Claims, 2 Drawing Sheets

δ
δ'
δmin
28'
28"
28
28'''
20
12
22
10
24
14
N2

Pa
δ
δmin
30
32
28
20
36
34
14
N2

CLEARANCE CONTROL METHOD FOR GAS TURBINE ENGINE

CROSS REFERENCE TO RELATED APPLICATIONS

Reference is hereby made to copending commonly-assigned U. S. patent applications titled "Thermal Clearance Control for Gas Turbine Engine" (app. Ser. No. 07/370,426) by F. M. Schwarz and C. J. Crawley, Jr. and "Active Clearance Control with Cruise Mode" (app. Ser. No. 07/370,434) by F. M. Schwarz and C. J. Crawley, Jr., filed on even date herewith and which disclose related subject matter.

1. Field of Invention

The present invention relates to a method for scheduling clearance control cooling air flow to a gas turbine engine or the like.

2. Background

The control of the radial clearance between the tips of rotating blades and the surrounding annular shroud in axial flow gas turbine engines is one known technique for proving engine efficiency. By reducing the blade tip to shroud clearance, designers can reduce the quantity of turbine working fluid which bypasses the blades, thereby increasing engine power output for a given fuel or other engine input.

"Active clearance control" refers to those clearance control arrangements wherein a quantity of cooling air is employed by the clearance control system to regulate the temperature of certain engine structures and thereby control the blade tip to shroud clearance as a result of the thermal expansion or contraction of the cooled structure. It is a feature of such active clearance control systems that the cooling air flow may be switched or modulated responsive to various engine, aircraft, or environmental parameters for causing a reduction in blade tip to shroud clearance during those portions of the engine operating power range wherein such clearance control is most advantageous.

A reduction of blade tip to shroud clearance must be achieved judiciously. For example, overcooling the turbine case supporting the annular shroud such that the shroud interferes with the rotating blade tips results in premature wear of the shroud or abrasion and damage to the blade tips. It is therefore important that the reduction in blade tip to shroud clearance achieved by such clearance controls systems must be designed so as to avoid the occurrence of blade tip and shroud interference which may ultimately cause deterioration of overall engine operating efficiency, or worse, damage to the engine internal components.

DISCLOSURE OF THE INVENTION

It is therefore an object of the present invention to provide a method for controlling radial clearance between the tips of a plurality of rotating blades and a surrounding annular shroud disposed within a gas turbine engine or the like.

The present invention provides a method for scheduling a modulated flow of cooling air to the gas turbine engine for thermally controlling the blade tip to shroud clearance. The method is based upon a recognition of certain facts, including:

- a flow of cooling air to achieve a given clearance varies with current engine power level; and
- the steady state blade tip to shroud clearance achieved by operation of the engine at a given power level will undergo a significant decrease during a transient period immediately following an increase in engine power level.

According to the present invention, a schedule of cooling air flow is determined for at least a normal operating range of engine power. The schedule is set to achieve at least a minimum blade tip to shroud clearance at any steady state operating power within the range, plus an additional clearance sized to accommodate the transient clearance decrease which follows a step change in engine power for each power level within the range.

The present invention optimizes the steady state operation of the engine within the power range by establishing the schedule to achieve the minimum required clearance at the maximum power level within the power range. The schedule further provides additional clearance at lower power levels within the range such that a step increase in engine power between a given lower power level and the maximum range power level results in a transient decrease in blade tip to shroud clearance which is approximately equal to the additional clearance provided for each lower power level.

The method according to the present invention thus provides, for each engine power level within the normal operating range, a corresponding scheduling cooling air flow rate and resulting steady state clearance. The steady state clearance at any given power level is sized to just accommodate the transient decrease in blade tip to shroud clearance following a step increase to maximum range power. The flow schedule thus provides a basis for controlling clearance which achieves the maximum steady state efficiency consistent with avoiding blade tip and shroud interference or rubout due to transient variation.

A further feature of the present invention results from a recognition of the fact that the normal power range and associated cooling air flow schedule as established relative to certain engine parameters, such as rotor angular speed $N_2$, are also a function of the ambient operating conditions. These conditions, including for example, ambient temperature and ambient pressure, are used by a further embodiment according to the present invention to provide a plurality of flow schedules particularly adapted to the current ambient conditions, for further optimizing engine efficiency throughout the range of expected ambient conditions.

The method of the present invention thus provides a variety of advantages as compared to prior art on/off clearance control systems and so called "constant clearance" systems. Other advantages will become apparent to those skilled in the art following a review of the following detailed description and appended claims and drawing figures.

DETAILED DISCLOSURE OF THE INVENTION

Figure 4:
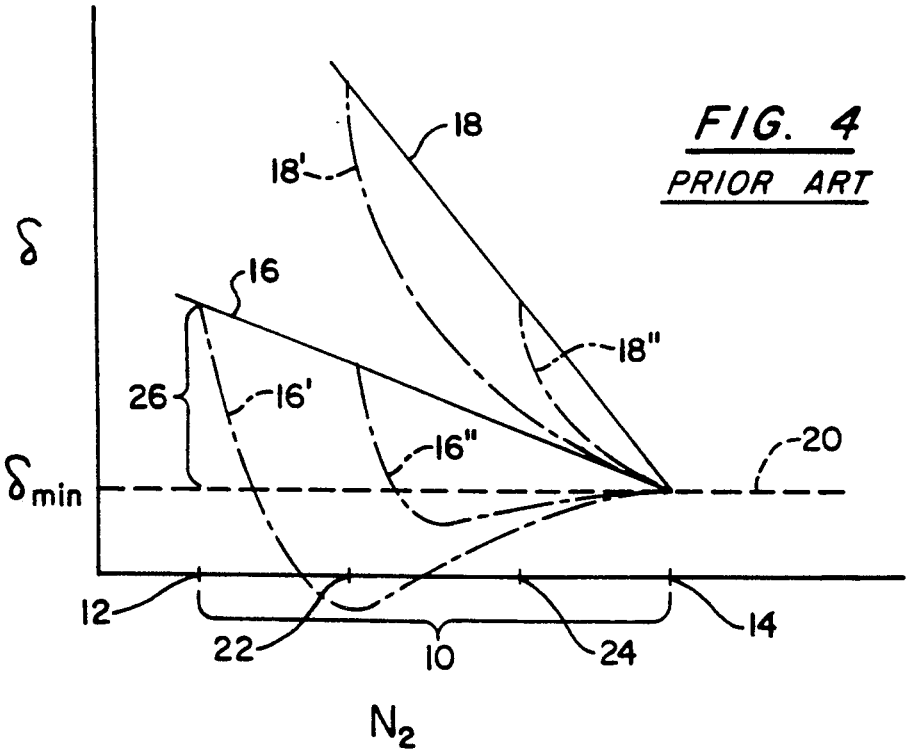
FIG. 4 PRIOR ART
FIG. 4 shows the prior art variation of blade tip to shroud clearance versus rotor speed, including curves representing the transient variation of clearance due to step changes in engine power level.

Referring to the drawing figures, and in particular to FIG. 4 thereof, the operation of a typical gas turbine engine active clearance control system will be described. FIG. 4 shows the steady state and transient response of blade tip to shroud radial clearance, $\delta$, on the vertical axis in response to engine power level on the horizontal axis as represented by the high rotor angular speed $N_2$ for a two spool gas turbine engine. Engine power normally varies over a range 10 having a minimum power level 12 and a maximum power level 14.

Blade tip to shroud clearance preferably should not drop below a minimum distance, $\delta_{min}$ distance, $\delta_{min}$ in order to avoid interference between the blade tips and shroud. Prior art "on/off" active clearance control cooling systems typically result in the sloping curves 16, 18 of steady state radial clearance in response to high rotor speed as exterior case cooling air flow and blade centrifugal force both increase. Hence, prior art on/off systems are typically configured so as to insure that the blade tip to shroud clearance at maximum expected engine power 14 is no less than the minimum desired clearance $\delta_{min}$ 20.

The curves 16, 18 of clearance versus rotor speed in FIG. 4 represent the steady state $\delta$ at any given power level $N_2$. What has not been recognized heretofore is that the blade tip to shroud clearance within the time period immediately following a change in engine power level does not follow a steady state curve 16, 18, but rather departs therefrom such that the blade tip to shroud clearance during such transient response may be greatly decreased from the steady state value.

For example, broken curves 18' and 18'' represent envelopes of the actual blade tip to shroud clearance of an engine experiencing a step increase in engine power level from corresponding intermediate power levels 22, 24 to the maximum engine power level 14. Curves 18' and 18'' show actual clearance dipping significantly below the steady state curve 18 at least temporarily as the engine output increases between the lower power levels 22, 24 and the maximum power level 14.

Such "snap acceleration" or step change in engine power level is a well recognized and regularly occurring situation for a gas turbine engine powering an aircraft or the like. Such step power level increases may occur, for example, during a change in altitude for turbulence avoidance, etc.

It is important to note that, both during steady state operation 18 and during transient conditions 18', 18'', the clearance $\delta$ between the blade tips and surrounding annular shroud is at all times, except at maximum engine power level operation 14, above the minimum selected clearance 20. Thus, the prior art clearance 18 of an active clearance control equipped engine, while better than an engine not equipped with an active clearance control system, still allows a significant flow of working fluid to bypass the blade stage via the clearance gap between the blade tips and shroud.

Prior art attempts to more aggressively cool the outer case while still retaining minimum blade tip to shroud clearance at maximum power 14, and without the knowledge of transient response of the clearance $\delta$, can produce a steady state curve 16 as shown in FIG. 4. Such curve, clearly unacceptable as will be explained below, reduces the extra clearance 26 at lower power levels within the range 10 but does not adequately allow for the transient decrease following a step increase in engine power.

Broken curves 16' and 16'' represent the envelope of clearance decrease corresponding to step increases in engine power level from, for example, the minimum power level 12 within the range 10 and an intermediate power 22 to maximum engine power 14. The broken curves 16', 16'' dip not only below the selected minimum clearance $\delta_{min}$ 20, but, for 16', actually dip below zero clearance, predicting the occurrence of interference between the blade tip and surrounding shroud. Such interference, for engines having abradable shrouds and abrasive blade tips, results in a grinding away of the shroud thereby increasing clearance during normal engine operations and, in effect, raising the steady state curve 16 in FIG. 4. For engines having nonabradable shrouds, such interference can result in damage to the blades and shrouds thus compromising engine efficiency and/or operability The prior art also teaches that a modulated flow of cooling air may be used to achieve a constant clearance between the blade tips and the shroud throughout the entire engine power range 10. Such constant clearance, possibly corresponding to the selected minimum clearance $\delta_{min}$ 20, will be appreciated by those skilled in the art having knowledge of the transient variation of $\delta$ with a step change in engine power, to be highly undesirable. In fact, even worse blade tip to shroud interference would be experienced by an engine having an active clearance control configured to attempt to maintain a constant steady state clearance The recognition of the departure of blade tip to shroud clearance from the steady state curves 16, 18 of the prior art that forms the basis of the method for scheduling the flow of cooling air to an active clearance control system according to the present invention.

According to the present invention, the steady state flow of cooling air to a thermal active clearance control system in a gas turbine engine is scheduled over the engine operating power range 10 so as to achieve a preselected minimum clearance $\delta_{min}$ 20 throughout the operating range 10, as well as an additional clearance at power levels less than the maximum range power level 14. This additional clearance $\delta'$ is selected so as to be substantially equivalent to the transient decrease in blade tip to shroud clearance which occurs in the period immediately following a step increase in engine power from the corresponding lower engine power level to the maximum power level 14.

Figure 1:
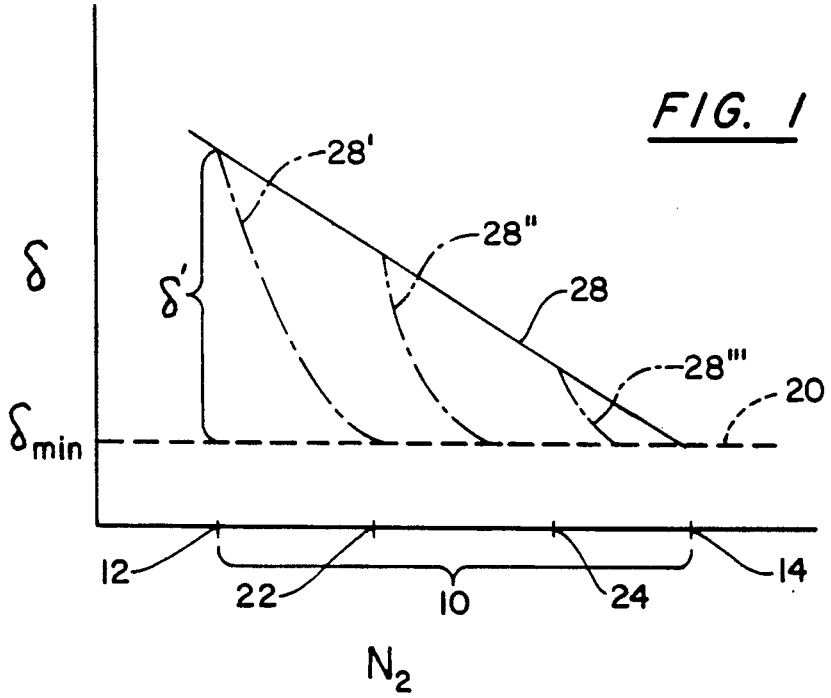
FIG. 1 is a graph of blade tip to shroud clearance versus rotary speed over the normal power range, including curves representing the transient variation in clearance due a step change in engine power level.

FIG. 1 shows a curve, 28 representing the variation of clearance $\delta$ with high rotor speed $N_2$ and scheduled according to the method of the present invention. Minimum clearance $\delta_{min}$ is achieved at maximum engine power 14, with such clearance increasing by the amount of $\delta'$ at power levels within the engine range 10. Unlike the prior art, it can be seen that the envelopes representing transient variation of clearance $\delta$ following step changes in engine power from lower levels 12, 22, 24 to maximum power 14 as shown by the corresponding broken curves 28' 28'' and 28''' never fall below the minimum desired clearance $\delta_{min}$ 20.

By properly sizing the excess clearance $\delta'$ at each lower power level within the operating range 10, the method according to the present invention provides an active clearance control cooling flow schedule which achieves the minimum steady state blade tip to shroud clearance at any point within the operating power range 10 which is consistent with protecting the engine as a result of a step increase in engine power.

It is further a feature of the present invention to recognize that the rotor speed corresponding to the maximum power level 14 is a function of ambient pressure and temperature. Hence, the curve 28 according to the present invention established so as to achieve a minimum desired clearance $\delta_{min}$ at maximum power level 14 at standard, sea level ambient conditions may be inappropriate for operation of the engine at higher altitudes and different ambient air temperatures.

Figure 2:
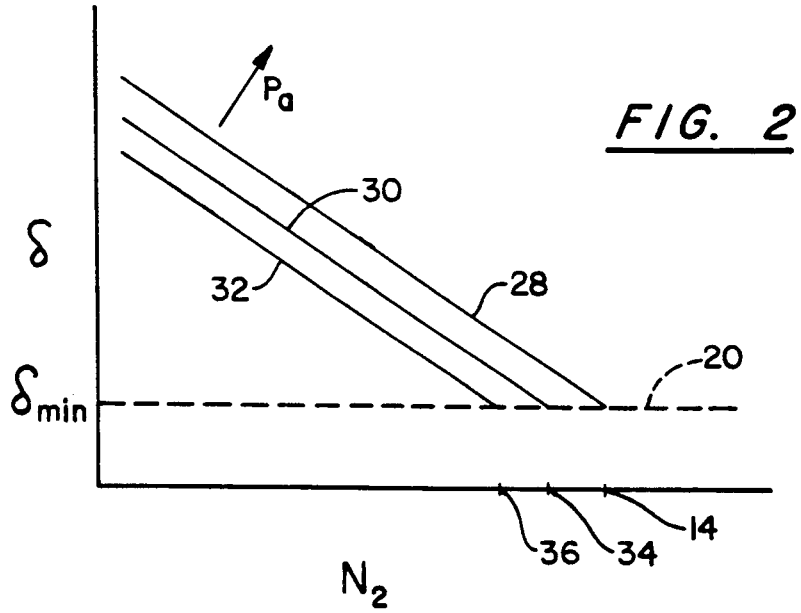
FIG. 2 shows the blade tip to shroud clearance in the normal power range at a plurality of ambient pressures.

FIG. 2 shows a variation of the rotor speed $N_2$ corresponding to maximum engine power in a normal operating range with ambient pressure $P_a$. Point 14 represents the maximum engine power of a particular gas turbine engine determined at sea level conditions, with lower value points 34, 36 representing high rotor speed at maximum engine power levels at ambient pressures lower than sea level as may correspond to operation of the aircraft and engine at higher altitudes.

It is apparent from FIG. 2 as the rotor speed corresponding to maximum engine power in the operating range decreases, it is appropriate and desirable to reschedule the cooling air flow so as to maintain the blade tip to shroud minimum clearance 20 for operation of the engine at maximum range power. Thus, at higher altitudes, curves 30 and 32 represent the steady state clearance $\delta$ consistent with optimum engine operating efficiency and accommodation of potential clearance transient effects which follow a step increase in engine power.

Figure 3:
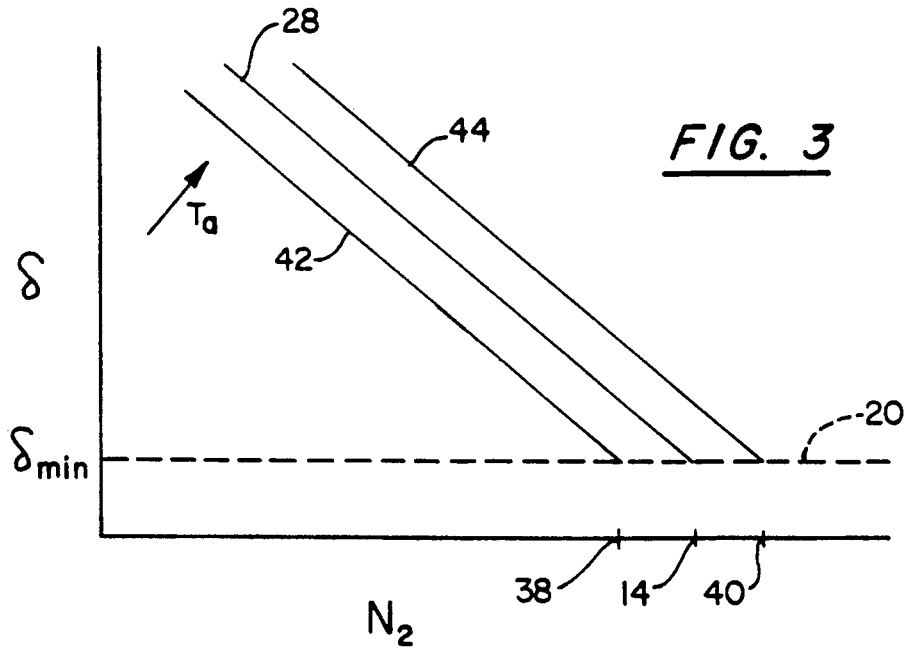
FIG. 3 shows the blade tip to shroud clearance over the normal power range at a plurality of ambient temperatures.

FIG. 3 shows the variation of high rotor speed $N_2$ with increasing or decreasing ambient temperature $T_a$ 40, 38. Such temperature changes are to be expected for operation in extremely warm climates or seasons, as well as at high altitudes. As with the curves shown in FIG. 2, the variation of the high rotor speed corresponding to maximum climb power, or the maximum power level in the expected engine operating range, results in a family of curves 42, 44 which optimize engine performance and operation.

It is thus a feature of the present invention to provide a plurality of schedules or equivalently a single, multidimensional, schedule for controlling cooling air flow to an active clearance control system responsive to, for example, rotor speed, ambient temperature and ambient pressure.

It is to be appreciated that the method of the present invention disclosed in terms of active clearance control systems which typically control clearance by exhausting a flow of cooling air on the exterior of the turbine case carrying the surrounding annular shroud, is also equally applicable to alternative clearance control systems, wherein the rotor itself is cooled or heated for the purpose of expanding or contracting the blade tips regularly and thereby controlling blade tip to shroud clearance during engine operation.

It is thus apparent that the method according to the present invention is well suited for optimizing overall engine performance and operation, maintaining the minimum blade tip to shroud clearance at all engine power levels within the operating range so as to avoid rub out or radial interference between the blade tips and surrounding shroud during the transient response following a snap acceleration or step change in engine power level. This method may be executed by a variety of physical hardware embodiments including analog, digital, hydraulic, pneumatic or other controllers or control logic systems, therefore, it should be noted that the preceding description is intended to merely illustrate a method for scheduling flow to the active clearance control system, and should not be interpreted as limiting the scope of the present invention except as specifically set forth in the claims appended hereinafter

We claim:

1. A method for modulating a cooling flow of air to a gas turbine engine operating within a power range, comprising the steps of determining a desired minimum clearance between a plurality of rotating blade tips within the gas turbine engine and a surrounding annular shroud;

establishing a cooling air flow rate schedule responsive to engine power within the power range, including the steps of (a) establishing a first cooling air flow rate corresponding to a maximum, steady state, engine power level within the power range, the first cooling air flow being sufficient to result in the blade tip to shroud clearance being equal to the determined minimum clearance;

(b) determining, for each of a plurality of other engine power levels within the operating range, the magnitude of a corresponding transient clearance decrease resulting from a step change in engine power from the other engine power level to the maximum power level, and (c) establishing, responsive to the determined transient clearance displacement, a plurality of corresponding air flow rates for the plurality of other engine steady state power levels.

2. The method as recited in claim 1, wherein the step of establishing a plurality of corresponding cooling air flow rates further includes the step of selecting corresponding cooling air flow rates to preserve the minimum blade tip to shroud clearance following a step change in the engine power demand signal between one of the other engine power levels and the maximum engine power level.

3. The method as recited in claim 2, wherein the step of selecting the corresponding cooling air flow rates further includes the step of selecting the corresponding cooling air flow rates so as to achieve approximately the minimum determined blade tip to shroud clearance following a step change in the engine power between one of the other power levels and the maximum engine power level.

4. The method as recited in claim 2, wherein the step of selecting the corresponding cooling air flow rates further includes the step of determining a corresponding cooling air flow rate for the maximum engine power level and the corresponding cooling air flow rates at the plurality of other engine power levels at a plurality of ambient air densities.

5. The method as recited in claim 4, wherein the step of determining cooling air flow rates responsive to ambient air density further includes the step of determining ambient static air pressure and temperature.

* * * * *